US010492567B2

(12) United States Patent
Casas

(10) Patent No.: US 10,492,567 B2
(45) Date of Patent: Dec. 3, 2019

(54) SHOE FASTENING SYSTEM

(71) Applicant: Zachary Casas, San Fernando, CA (US)

(72) Inventor: Zachary Casas, San Fernando, CA (US)

( * ) Notice: Subject to any disclaimer, the term of this patent is extended or adjusted under 35 U.S.C. 154(b) by 0 days.

(21) Appl. No.: 15/599,220

(22) Filed: May 18, 2017

(65) Prior Publication Data

US 2017/0332736 A1 Nov. 23, 2017

Related U.S. Application Data

(60) Provisional application No. 62/339,001, filed on May 19, 2016.

(51) Int. Cl.
*A43C 11/14* (2006.01)
*A43C 11/22* (2006.01)

(52) U.S. Cl.
CPC ..... *A43C 11/1493* (2013.01); *A43C 11/22* (2013.01)

(58) Field of Classification Search
CPC ..... A43C 11/1493; A43C 11/22; A43C 11/00; Y10T 24/37; Y10T 24/3742; Y10T 24/3787
See application file for complete search history.

(56) References Cited

U.S. PATENT DOCUMENTS 3,205,544 A * 9/1965 Streule ..... A43C 11/1493 24/306
4,489,719 A * 12/1984 Lapenskie ..... A61F 13/066 36/89
5,846,040 A * 12/1998 Ueno ..... F16B 19/008 411/45
5,894,640 A * 4/1999 Dewey ..... A43C 11/00 24/306
8,898,936 B1 12/2014 Thompson-Boothe et al.
9,320,322 B1 4/2016 Castaneda et al.
9,491,989 B2 11/2016 Rivas
9,743,715 B1 8/2017 Brekke-Jones
2002/0084295 A1* 7/2002 Martindale ..... A45C 1/04 224/219
2003/0221334 A1* 12/2003 McFee ..... A43C 11/16 36/50.1
2004/0134100 A1* 7/2004 McVicker ..... A43B 1/0081 36/50.1

(Continued)

FOREIGN PATENT DOCUMENTS

WO WO-2016075621 A1 * 5/2016 ..... A43B 5/0433

*Primary Examiner* — Robert Sandy
*Assistant Examiner* — Louis A Mercado
(74) *Attorney, Agent, or Firm* — Morrison & Foerster LLP

(57) ABSTRACT

Systems and methods for fastening a shoe. In some embodiments, a shoe fastening system includes an insert strap having a strap fastener and a first strap-eyelet connector configured to attach to a shoe using only one shoe eyelet, and a receiving strap having a strap-strap connector and a second strap-eyelet connector configured to attach to a shoe using only one shoe eyelet, where the strap fastener is sized to be inserted into the strap-strap connector, and the first strap-eyelet connector and second strap-eyelet connector each include a head having a diameter greater than or equal to ¼ of an inch and a shaft having a diameter of less than or equal to 3/16 of an inch.

10 Claims, 7 Drawing Sheets

(56) References Cited

U.S. PATENT DOCUMENTS

| | | | | |
|---|---|---|---|---|
| 2004/0226189 | A1* | 11/2004 | Semitka | A43C 3/00 36/50.5 |
| 2005/0044747 | A1* | 3/2005 | Doody | A43B 3/24 36/50.1 |
| 2008/0141560 | A1* | 6/2008 | Lewis | A43B 3/0078 36/50.1 |
| 2008/0307675 | A1* | 12/2008 | Krauss | A43B 3/163 36/92 |
| 2010/0137806 | A1* | 6/2010 | McCluskey | A61M 5/1418 604/179 |
| 2011/0061266 | A1* | 3/2011 | Hsieh | A43B 7/141 36/107 |
| 2011/0289743 | A1* | 12/2011 | Hill | A43C 11/22 24/713.6 |
| 2013/0263473 | A1* | 10/2013 | Young | A43C 11/22 36/83 |
| 2013/0283639 | A1* | 10/2013 | Williams | A43B 1/0081 36/83 |
| 2014/0007391 | A1* | 1/2014 | Siegfreid | A43C 7/00 24/713 |
| 2014/0196317 | A1* | 7/2014 | Katz | A43B 7/20 36/89 |
| 2015/0047228 | A1* | 2/2015 | Pernia | A43B 1/0081 36/100 |
| 2017/0231327 | A1* | 8/2017 | Frydlewski | A43B 1/0081 12/142 LC |
| 2017/0245596 | A1* | 8/2017 | Woodward | A43C 11/008 |

* cited by examiner

SHOE FASTENING SYSTEM

CROSS-REFERENCE TO RELATED APPLICATIONS

This application claims priority from U.S. provisional application No. 62/339,001, filed May 19, 2016, the content of which is incorporated by reference in its entirety.

TECHNICAL FIELD

This disclosure generally relates to devices for fastening shoes, and more specifically to shoelace replacement systems.

BACKGROUND

People with disabilities, special needs, or limited use of their hands often cannot tie shoes with conventional laces. This includes people with neuromuscular disorders, one arm, one hand, missing fingers, arthritis, and injured or broken hands or arms. Tying shoelaces requires manual dexterity, nimble fingers, and hand-eye coordination.

Many types and styles of shoes are only available with laces. These include shoes designed for a particular purpose or need, such as work boots, hiking boots, running shoes, orthopedic shoes, recreational equipment, and more. Such specialty shoes are difficult for some people to wear without assistance.

Shoes with hook-and-loop fasteners, or Velcro, are easier to fasten and unfasten, but often suffer from significant drawbacks. Traditionally, manufacturers offer shoes with hook-and-loop fasteners in a limited number of styles, sizes, colors, and widths, and many models are only made for children. Furthermore, people suffering from temporary disabilities, such as those due to injury, often cannot afford to purchase expensive shoes with alternative fasteners for short-term use.

People with special needs would benefit from devices that allow them to wear the wide variety of shoes that are currently only manufactured for use with shoelaces. Traditional shoelace replacement systems are not designed to be easily installed on or removed from a shoe by a person with limited dexterity without assistance.

SUMMARY

Provided herein is a shoe fastening system that includes an insert strap containing a strap fastener and a first strap-eyelet connector configured to attach to a shoe using only one shoe eyelet, and a receiving strap containing a strap-strap connector and a second strap-eyelet connector configured to attach to a shoe using only one shoe eyelet. In some embodiments, the insert strap is sized to be inserted through the strap-strap connector. The first strap-eyelet connector and second strap-eyelet connector may each include a head having a diameter greater than or equal to ¼ of an inch and a shaft having a diameter of less than or equal to 3/16 of an inch.

As an exemplary advantage, the shoe fastening systems described herein can use fasteners that are easy for a person with limited dexterity to use to secure to a shoe. As another exemplary advantage, the system can use a single fastener for fastening each component to a shoe. The system can use fasteners that each attach to a single shoe eyelet. Using fasteners that can attach to a single shoe eyelet can eliminate the need for aligning bolts or brackets to match up with multiple shoe eyelets, including, for example, when the distances between shoe eyelets vary between shoes. As another exemplary advantage, the shoe fastening systems described herein are adaptable for use with a variety of fasteners, including fasteners that are compatible with a variety of disabilities. For example, embodiments of the systems are compatible with fasteners that are secured with twisting or pressure. As another exemplary advantage, the shoe fastening system allows a user to customize fit by varying the location of the straps on a shoe by selecting particular shoe eyelets to which the straps are connected. As another exemplary advantage, the shoe fastening system can be installed or removed on a shoe with ease, which allows a user with limited dexterity to transfer the system between shoes as needed. As another exemplary advantage, the shoe fastening system can be permanently or semi-permanently attached to the shoe. As another exemplary advantage, a user can fasten or unfasten the shoe fastening system on a foot with limited dexterity. For example, a user can use the shoe fastening system without fingers or fingernails.

In some embodiments, the strap fastener includes a hook and loop fastener. In some embodiments, the shaft of at least one of the first and second strap-eyelet connectors includes a base having a diameter greater than or equal to ¼ of an inch. In some embodiments, at least one of the first and second strap-eyelet connectors is selected from the group consisting of a ratchet rivet and a push-in rivet. In some embodiments, at least one of the first and second strap-eyelet connectors includes a Chicago screw comprising a female internally-threaded nut and a bolt. In some embodiments, at least one of the first and second strap-eyelet connector includes a bolt and a nut, wherein the nut is selected from the group consisting of an acorn nut, crown hex nut, blind nut, cap nut, and domed cap nut. In some embodiments, the strap-eyelet connector further comprises a locking washer in contact with the bolt or the nut.

In some embodiments, the strap-strap connector includes a ring. In some embodiments, the strap-strap connector includes a slot aperture in the receiving strap. In some embodiments, the strap-strap connector includes a grommet. In some embodiments, the grommet is a rectangular grommet or an oval grommet.

In some embodiments, at least one of the insert strap and the receiving strap contains a material selected from the group consisting of nylon, cotton, and leather.

Also provided herein is a shoe fastening system including a strap containing a strap-strap connector, a strap fastener, and a strap-eyelet connector between the strap-strap connector and the strap fastener, wherein the strap is sized to be inserted through the strap-strap connector, and the strap-eyelet connector includes a head having a diameter greater than or equal to ¼ of an inch and a shaft having a diameter of less than or equal to 3/16 of an inch. As an exemplary advantage, the shoe fastening system can be affixed to a shoe using only a single strap-eyelet connector. As another exemplary advantage, the shoe fastening system can provide additional support, for example, by wrapping around the ankle shaft or ankle support portion of a shoe or boot. Such a system can provide additional support to certain types of footwear including, for example, a high-top shoe or a high cut work or hiking boot.

In some embodiments, the strap fastener includes a hook and loop fastener. In some embodiments, the shaft of the strap-eyelet connector includes a base having a diameter greater than or equal to ¼ of an inch. In some embodiments, the strap-eyelet connector is selected from the group consisting of a ratchet rivet and a push-in rivet. In some embodiments, the strap-eyelet connector includes a Chicago screw comprising a female internally-threaded nut and a bolt. In some embodiments, the strap-eyelet connector contains a bolt and a nut, wherein the nut is selected from the group consisting of an acorn nut, crown hex nut, blind nut, cap nut, and domed cap nut. In some embodiments, the strap-strap connector is selected from the group consisting of a ring, a slot aperture, and a grommet.

Also provided herein is a method of fastening a shoe using a shoe fastening system, wherein the shoe includes a first shoe eyelet and a second shoe eyelet, the method including inserting the shaft of the first strap-eyelet connector through the first shoe eyelet, coupling the shaft of the first strap-eyelet connector to the head of the first strap-eyelet connector, inserting the shaft of the second strap-eyelet connector through the second shoe eyelet, coupling the shaft of the second strap-eyelet connector to the head of the second strap-eyelet connector, inserting the insert strap through the strap-strap connector, and securing the insert strap to the receiving strap with the strap fastener. As an exemplary advantage, the methods provided herein may be more easily performed by a person with limited dexterity. For example, a person of limited dexterity can secure a device in accordance with an embodiment to a shoe and secure the shoe to his or her feet without assistance.

In some embodiments, the method includes inserting the shaft of the first strap-eyelet connector through the insert strap, and inserting the shaft of the second strap-eyelet connector through the receiving strap.

In some embodiments, the strap fastener includes a hook and loop fastener. In some embodiments, the shaft of at least one of the first and second strap-eyelet connectors includes a base having a diameter greater than or equal to ¼ of an inch. In some embodiments, at least one of the first and second strap-eyelet connectors is selected from the group consisting of a ratchet rivet and a push-in rivet. In some embodiments, at least one of the first and second strap-eyelet connectors is a ratchet rivet comprising a male member and a female member. In some embodiments, at least one of the first and second strap-eyelet connectors is a push-in rivet comprising a male member and a female member. In some embodiments, at least one of the first and second strap-eyelet connector comprises a Chicago screw comprising a female internally-threaded nut and a bolt. In some embodiments, the strap-strap connector is a ring.

Also provided herein is a method of fastening a shoe using a shoe fastening system, wherein the shoe includes a first shoe eyelet, the method including inserting the shaft of the strap-eyelet connector through the shoe eyelet, coupling the shaft of the strap-eyelet connector to the head of the strap-eyelet connector, wrapping the strap around a shaft of the shoe, inserting the strap through the strap-strap connector, and securing the strap to the strap-strap connector with the strap fastener.

In some embodiments, the method further includes inserting the shaft of the strap-eyelet connector through the strap. In some embodiments, the strap fastener includes a hook and loop fastener. In some embodiments, the shaft of the strap-eyelet connector includes a base having a diameter greater than or equal to ¼ of an inch. In some embodiments, the strap-eyelet connector is selected from the group consisting of a ratchet rivet and a push-in rivet. In some embodiments, the strap-eyelet connector includes a Chicago screw comprising a female internally-threaded nut and a bolt. In some embodiments, the strap-strap connector is a ring.

DETAILED DESCRIPTION

Figure 1:
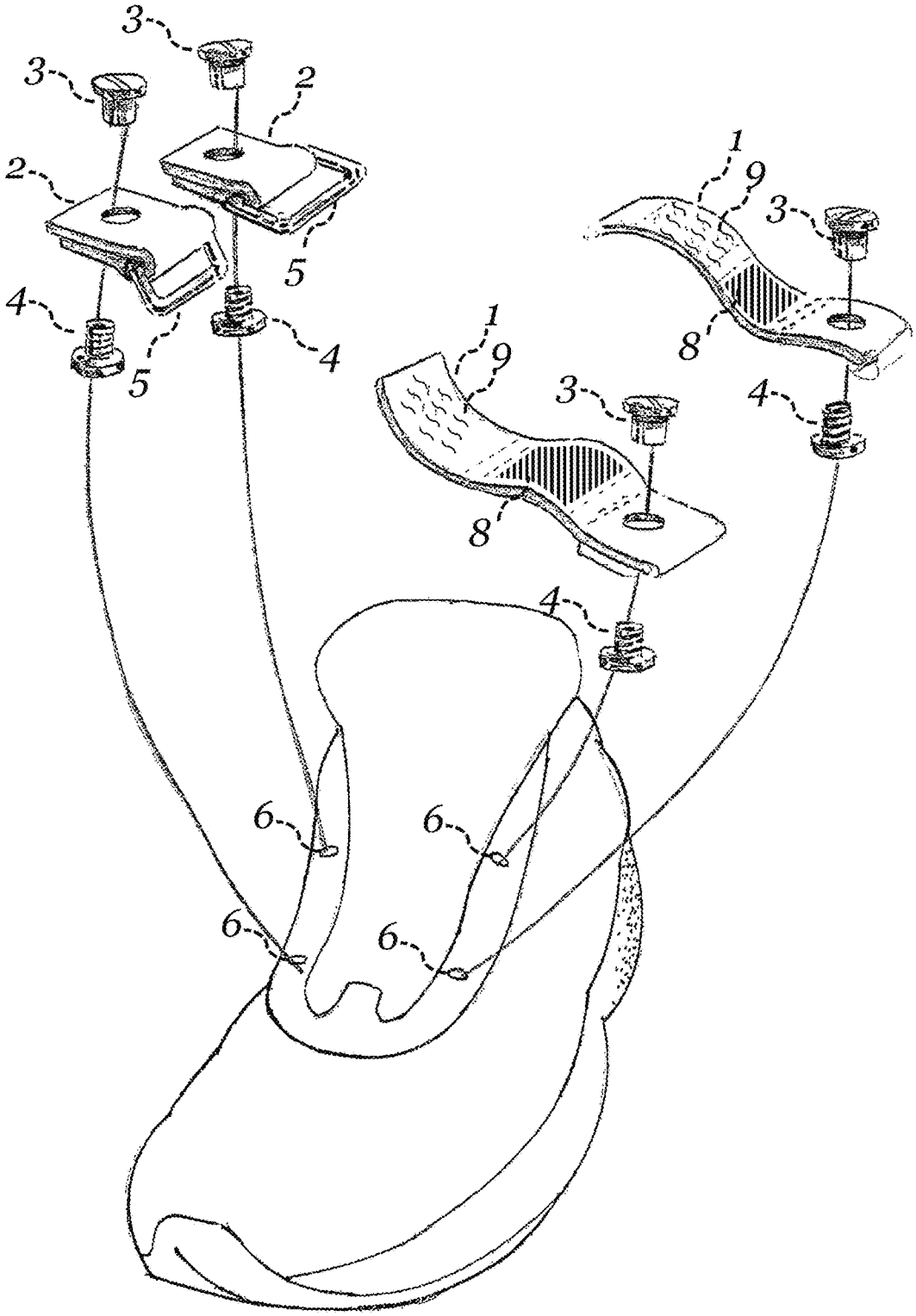
FIG. 1 provides a schematic representation of an unassembled exemplary embodiment of a shoe fastening system according to examples of the disclosure. Each component of the system can be secured to the shoe with a Chicago screw by placing the female internally-threaded nut 3 on one side of the shoe eyelet 6, and the bolt 4 on the other side of the shoe eyelet. Other types of strap-eyelet connectors are described herein.

FIG. 1 represents an isometric view of an exemplary shoe fastening system in accordance with an embodiment. The shoe fastening system includes an insert strap 1 that includes a strap fastener 8 and 9 and a first strap-eyelet connector configured to attach to a shoe using only one shoe eyelet 6, and a receiving strap 2 that includes a strap-strap connector 5 and a second strap-eyelet connector configured to attach to a shoe using only one shoe eyelet 6, wherein the first strap-eyelet connector and second strap-eyelet connector each have a head having a diameter greater than the diameter (in some embodiments, greater than or equal to ¼ of an inch) of a shoe eyelet in order to anchor the strap-eyelet connector to the shoe and a shaft having a diameter (in some embodiments, less than or equal to 3/16 of an inch) of less than the diameter of a shoe eyelet in order to pass through the eyelet.

Figure 2:
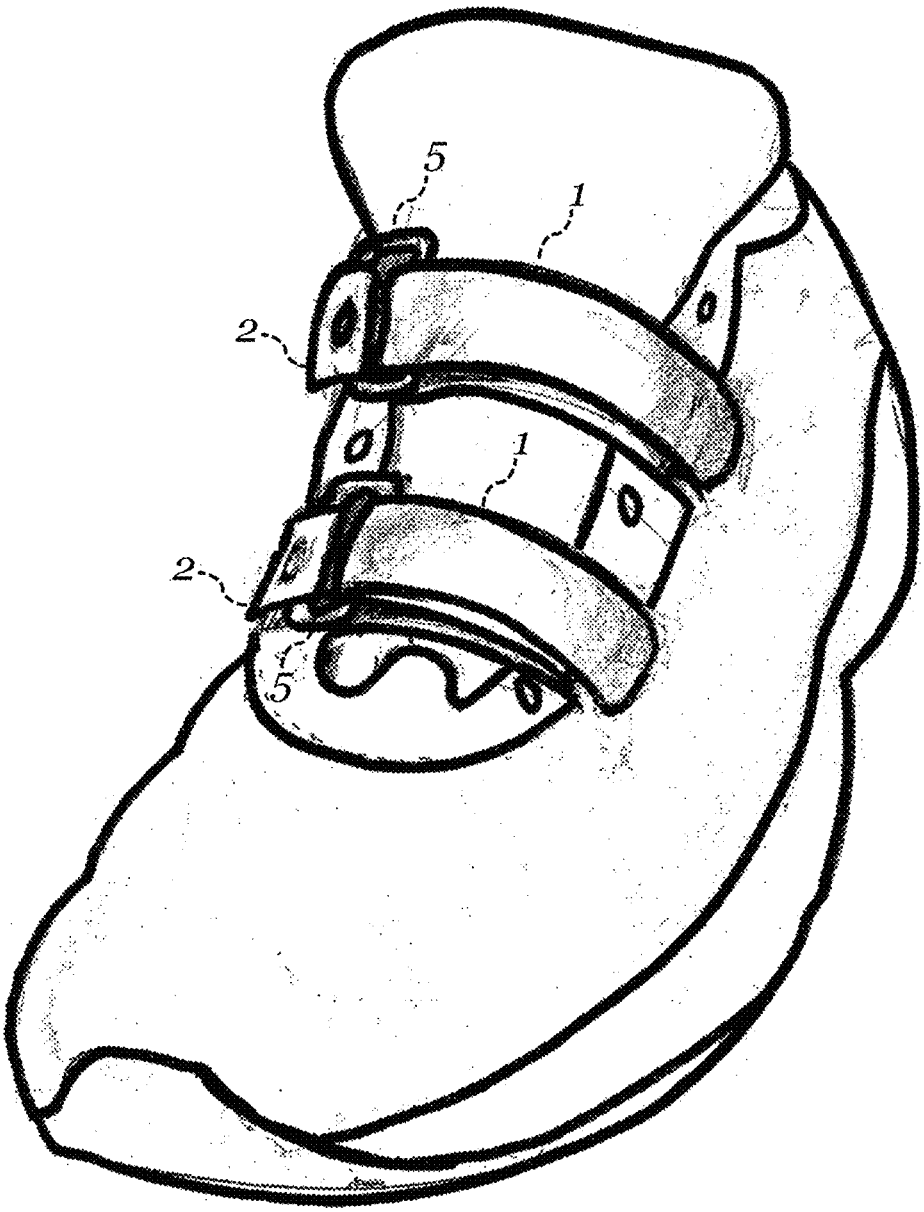
FIG. 2 provides a schematic representation of an assembled exemplary embodiment of a shoe fastening system according to examples of the disclosure.

FIG. 2 represents an isometric view of an exemplary shoe fastening system in a closed position in accordance with an embodiment. The insert strap 1 and receiving strap 2 can be any size appropriate for closing a shoe, and sizes can be adapted for individual shoes or users. Generally, the insert strap and the strap fastener are sized to be inserted into or through the strap-strap connector. In some embodiments, a leading end of the insert strap is tapered or rounded at the corners to improve the ease with which the insert strap can be inserted through the strap-strap connector. In some embodiments, the leading end of the insert strap is fitted with a tapered metal tip. In some embodiments, the leading end of the insert strap includes a pull tab, such as a ring or tab that can be used to pull the strap. In some embodiments, an additional piece of fabric or strap is attached to the leading end of the insert strap. In some embodiments, the leading end of the insert strap does not include the strap fastener.

In some embodiments, including the exemplary embodiments described above, the leading end of the insert strap remains loose when the strap is fastened. Leaving the leading end of the strap loose can allow a person with limited dexterity, such as a person without fingers or fingernails, to grasp the leading end of the insert strap without having to scrape it away from the other end of the strap to which it is attached. In some embodiments, the metal tip, pull tab, fabric, or leading end of the insert strap allow the user to generate additional leverage when disengaging the strap fastener.

In some embodiments, the insert strap is between 2 inches and 8 inches long. In some embodiments, the insert strap is between 3 inches and 7 inches long. In some embodiments, the insert strap is between 4 and 6 inches long. In some embodiments, the insert strap is between 5 and 6 inches long. In some embodiments, the receiving strap is between 0.5 inches and 8 inches long. In some embodiments, the receiving strap is between 1 inch and 7 inches long. In some embodiments, the receiving strap is between 2 and 6 inches long. In some embodiments, the receiving strap is between 3 and 5 inches long.

Returning to FIG. 1, in some embodiments, the strap fastener 9 comprises a hook and loop fastener, a mushroom-head fastener (including, for example, a DUAL LOCK™ fastener or DUOTEC® fastener), a slidingly engaging fastener, a button and buttonhole, a snap, a clip, or a buckle. The buckle can be, for example, a clasp, a heel roller buckle, a loop and hook buckle, a clamp buckle, or a snap-fit or side-release buckle. In some embodiments, the strap fastener comprises durable materials that can withstand repeated use, such as industrial strength fasteners that do not degrade or fall off the shoe with repeated use. In some embodiments, the insert strap 1 is inserted through an aperture in the strap-strap connector 5, and fastened using the strap fastener.

In some embodiments, the insert strap 1 is connected to a shoe eyelet 6 by a strap-eyelet connector. In some embodiments, the strap-eyelet connector includes a female member and a male member. In some embodiments, the female portion includes a head portion and a shaft portion (sometimes called the barrel portion). In some embodiments, the shaft portion of the female member has a diameter smaller than the diameter of the shoe eyelet into which it will be inserted. The length of the shaft portion of the female member can be any length appropriate for securing a strap to a shoe eyelet. In some embodiments, the shaft portion of the female member has a diameter between 2/32 of an inch and 1/4 of an inch. In some embodiments, the shaft portion of the female member has a diameter of 3/32 of an inch, 1/8 of an inch, 5/32 of an inch, or 3/16 of an inch. In some embodiments, the length of the shaft portion of the female member is between 1/8 of an inch and 1/2 of an inch. In some embodiments, the shaft portion of the female member comprises a cavity adapted to removably engage the male member. In some embodiments, the cavity of the shaft portion of the female member is cylindrical. In some embodiments, the cavity of the shaft portion of the female member is internally threaded. In some embodiments, the female member has a head portion with a diameter greater than the diameter of the eyelet into which it will be inserted. In some embodiments, the head portion has a diameter of between 3/32 of an inch and 1/2 of an inch.

In some embodiments, the male portion comprises a head portion and a shaft portion. In some embodiments, the shaft portion of the male member has a diameter smaller than the diameter of the cavity of the female member into which it will be inserted. In some embodiments, the shaft portion of the male member has a diameter between 2/32 of an inch and 1/4 of an inch. In some embodiments, the shaft portion of the male member has a diameter of 3/32 of an inch, 1/8 of an inch, 5/32 of an inch, or 3/16 of an inch. In some embodiments, the length of the shaft portion of the male member is between 1/8 of an inch and 1/2 of an inch. In some embodiments, the shaft portion of the male member is threaded. In some embodiments, the male member has a head portion with a diameter greater than the diameter of the eyelet into which it will be inserted. In some embodiments, the head portion has a diameter of between 3/32 of an inch and 1/2 of an inch.

In some embodiments, at least one of the strap-eyelet connectors comprises a Chicago screw comprising a female internally-threaded nut 3 mated to a bolt 4, a ratchet rivet, a push-in rivet, a snap rivet, or a snap. In some embodiments, at least one of the strap-eyelet connectors comprises a bolt and a nut, wherein the nut is selected from the group consisting of an acorn nut, crown hex nut, blind nut, cap nut, and domed cap nut. In some embodiments, the bolt is permanently affixed to the strap. In some embodiments, the nut is permanently affixed to the strap.

In some embodiments, the strap-eyelet connector further comprises a locking washer. In some embodiments, the locking washer prevents or reduces the strap-eyelet connector from loosening due to unscrewing rotation or vibration during normal use. In some embodiments, the locking washer allows a user, such as a user with limited dexterity, to secure the strap-eyelet connector to the shoe with reduced rotational force. In some embodiments, the locking washer is placed around the shaft portion of the male member and/or the shaft portion of the female member and in contact with the head of the male member. In some embodiments, the locking washer is placed around the shaft portion of the male member and/or the shaft portion of the female member and in contact with the head portion of the female internally-threaded nut. In some embodiments, the locking washer is also placed in contact with a strap and/or the shoe being secured. Non-limiting examples of a locking washer include a split washer (also known as a spring lock washer), a Belleville washer (also known as a cupped spring washer or a conical washer), a toothed lock washer (also known as a serrated or star washer), or a curved disc spring washer.

In some embodiments, the strap-eyelet connectors can be affixed to the shoe with or without tools. For example, in some embodiments a ratchet rivet, a push-in rivet, a snap rivet, or a snap can be secured by applying pressure or force to join the interlocking pieces of the rivet or snap. In some embodiments, the rivet can be easily disengaged to remove the rivet and the strap from the shoe. In some embodiments, the rivet permanently or semi-permanently attaches the strap to the shoe. In some embodiments, the rivet is made out of or comprises nylon or plastic.

In some embodiments, the receiving strap 2 is connected to a shoe eyelet 6 by a strap-eyelet connector. In some embodiments, the strap-eyelet connector is a Chicago screw comprising a female internally-threaded nut 3 mated to a bolt 4, a ratchet rivet, a snap rivet, or a snap. In some embodiments, the strap-eyelet connector comprises a male member and a female member, as described above. In some embodiments, the strap-eyelet connector further comprises a locking washer, as described above.

In some embodiments, the receiving strap 2 also includes a strap-strap connector 5. In some embodiments, the strap-strap connector connects the insert strap to the receiving strap. In some embodiments, the strap-strap connector assists the user in increasing the leverage or tension on the insert strap when securing the shoe. As an exemplary advantage, the strap-strap connector can allow a user with limited dexterity to increase the tension on the insert strap using one hand. As another exemplary advantage, the strap-strap connector can assist the user with positioning or securing the strap fastener when securing the shoe. In some embodiments, the strap-strap connector comprises a ring, including, for example, a D-ring, square ring, slide, or loop. In some embodiments, the strap-strap connector comprises a slot aperture. In some embodiments, the strap-strap connector comprises a grommet. In some embodiments, the grommet is a rectangular grommet or an oval grommet.

In some embodiments, at least one of the insert strap and the receiving strap comprises a stretch fabric, commonly known as "elastic." In some embodiments, the stretch fabric comprises spandex or elastane (also known as LYCRA®). As an exemplary advantage, in some embodiments a shoe fastening system wherein at least one of the insert strap or receiving strap comprises a stretch fabric can remain secured with the strap fastener while still allowing the user to slip on and off the shoe. In some embodiments, the stretch fabric allows the strap to stretch temporarily, and therefore accommodate the insertion or removal of a foot from the shoe, while the strap fastener remains secured or closed, yet return to its original size and shape once the foot has been inserted or removed.

As another exemplary advantage, the stretch fabric can convert a shoe with eyelets for shoelaces into a slip-on shoe with adjustable levels of tension. In some embodiments, the strap fastener can be secured in a manner that provides varying amounts of tension. Varying the position or length of the strap can vary the tension on the strap. For example, a user can tighten the strap to a desired amount of tension and secure the strap in that position using the strap fastener. In some embodiments, an insert strap or receiving strap that comprises stretch fabric allows the user to secure the strap fastener in a position that provides a desired amount of tension while also allowing the strap to temporarily stretch to accommodate the insertion or removal of a foot from the shoe without releasing the strap fastener.

Figure 3:
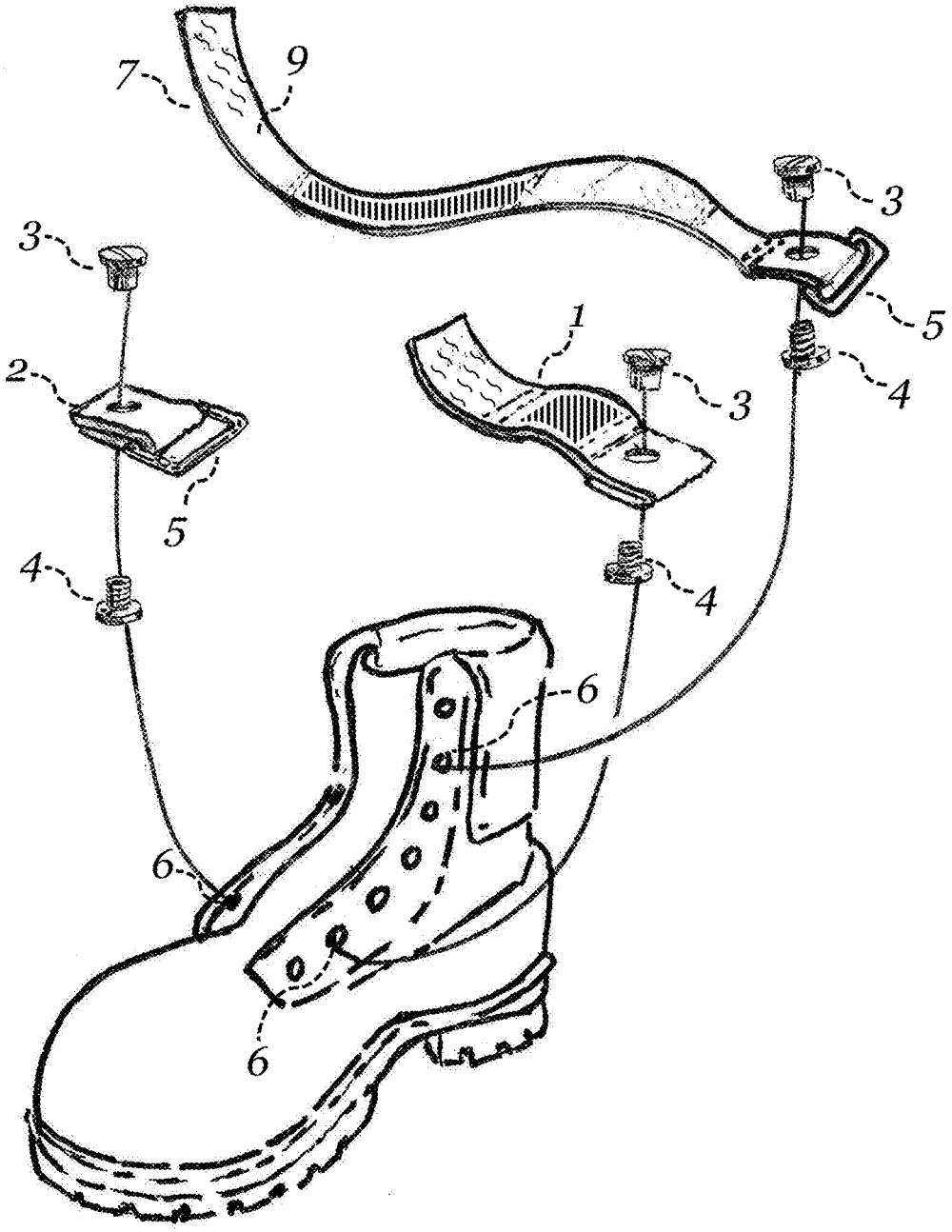
FIG. 3 provides a schematic representation of two unassembled exemplary embodiments of a shoe fastening system according to examples of the disclosure. The first embodiment includes an insert strap 1, a receiving strap 2, a first strap-eyelet connector, and a second strap-eyelet connector. The second embodiment includes an elongated strap 7 containing a ring 5 and a strap fastener, such as a hook-and-loop fastener, and a strap-eyelet connector that includes a male member and a female member. Although the strap-eyelet connectors depicted in the first embodiment and the second embodiment of FIG. 3 are depicted as a Chicago screw that includes a female internally-threaded nut 3 mated to a bolt 4, this depiction is merely an exemplary illustration of a strap-eyelet connector that includes a male member and a female member and is representative of other strap-eyelet connectors that include a male member and a female member, such as a ratchet rivet or a push-in rivet.
Figure 4:
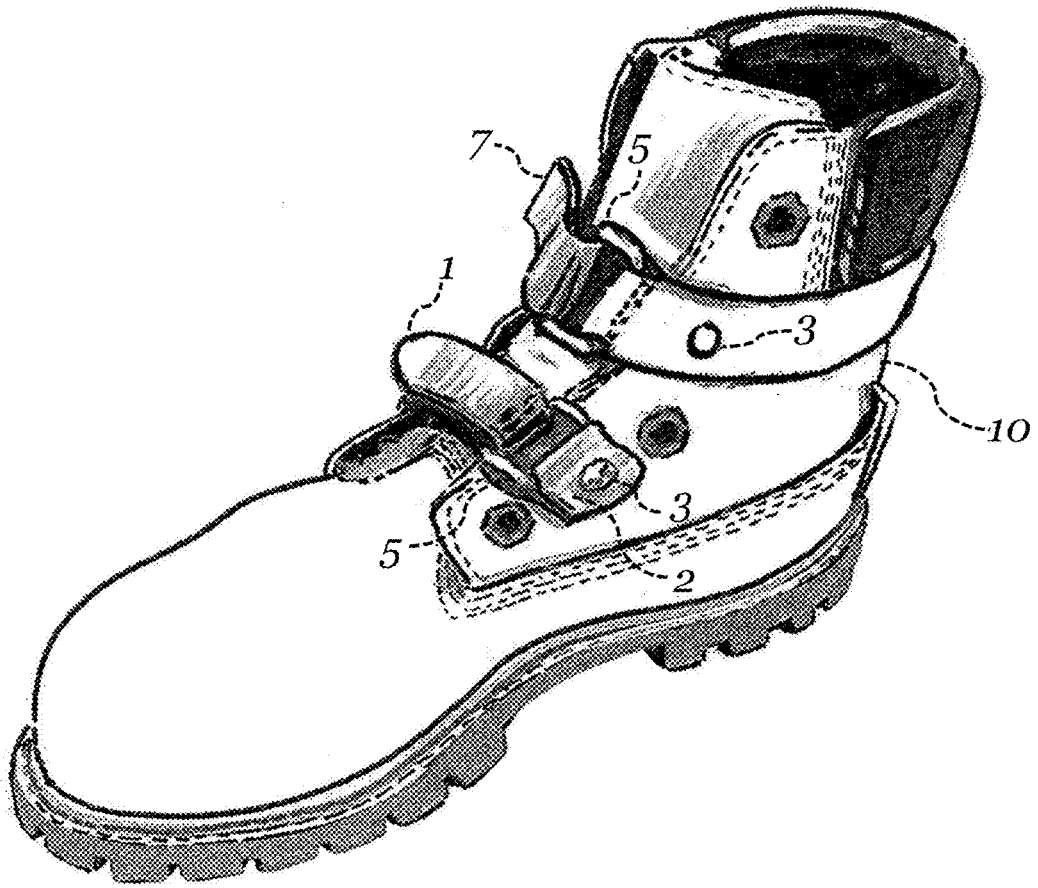
FIG. 4 provides a schematic representation of two assembled exemplary embodiments of a shoe fastening system according to examples of the disclosure.

FIG. 3 represents an isometric view of an exemplary shoe fastening system in accordance with an embodiment, and FIG. 4 represents an isometric view of the exemplary shoe fastening system in a closed configuration in accordance with an embodiment. The shoe fastening system includes a strap 7 comprising a strap-strap connector 5, a strap fastener 9, and a strap-eyelet connector, wherein the strap-eyelet connector has a head having a diameter greater than the diameter of a shoe eyelet in order to anchor the strap-eyelet connector to the shoe (generally greater than or equal to ¼ of an inch) and a shaft having a diameter of less than the diameter of a shoe eyelet in order to pass through the eyelet (generally less than or equal to 3⁄16 of an inch). In some embodiments, the strap-eyelet connector can attach the shoe to the strap at a position located between the strap-strap connector and the strap fastener. In some embodiments, the shaft of the strap-eyelet connector comprises a base having a diameter greater than or equal to ¼ of an inch. In some embodiments, the elongated strap 7 is connected at a first end to a shoe eyelet 6 by strap-eyelet connector. In some embodiments, the strap-eyelet connector is a Chicago screw comprising a female internally-threaded nut 3 mated to a bolt 4, a ratchet rivet, a snap rivet, or a snap. In some embodiments, a second end of the elongated strap 7 contains a strap fastener, such as a hook-and-loop fastener, which contains hooks 9 and loops 8. In some embodiments, the strap fastener is a hook and loop fastener, a mushroom-head fastener (including, for example, a DUAL LOCK™ fastener or DUOTEC® fastener), a slidingly engaging fastener, a button and buttonhole, a snap, a clip, or a buckle. The buckle can be, for example, a clasp, a heel roller buckle, a loop and hook buckle, a clamp buckle, or a snap-fit or side-release buckle. In some embodiments, the second end of the elongated strap 7 is wrapped around the shoe 10, inserted through an aperture in the strap-strap connector 5, and fastened using the strap fastener 9.

The elongated strap 7 can be any size appropriate for closing a shoe, and sizes can be adapted for individual shoes or users. Generally, the strap and the strap fastener are sized to be inserted into or through the strap-strap connector. In some embodiments, a leading end of the insert strap is tapered or rounded at the corners to improve the ease with which the insert strap can be inserted through the strap-strap connector. In some embodiments, the leading end of the insert strap is fitted with a metal tip. Strap-strap connectors are described in detail above.

In some embodiments, the strap is between 2 inches and 20 inches long. In some embodiments, the strap is between 6 inches and 15 inches long. In some embodiments, the strap is between 8 and 14 inches long. In some embodiments, the strap is between 9 and 13 inches long. In some embodiments, the elongated strap comprises a stretch fabric, as described above.

Figure 5A:
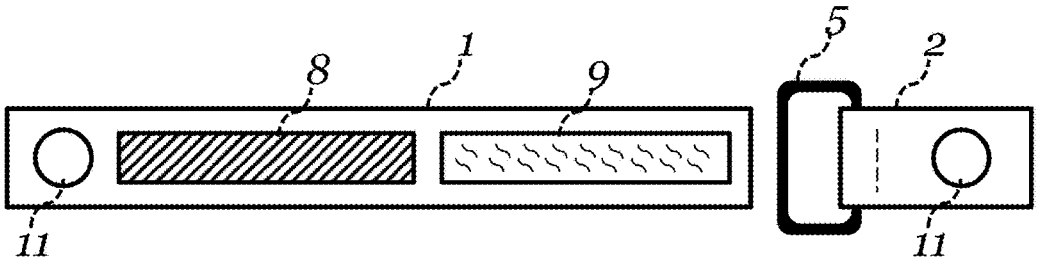
FIG. 5A provides a schematic representation of exemplary components of an embodiment of a shoe fastening system according to examples of the disclosure.
Figure 5B:
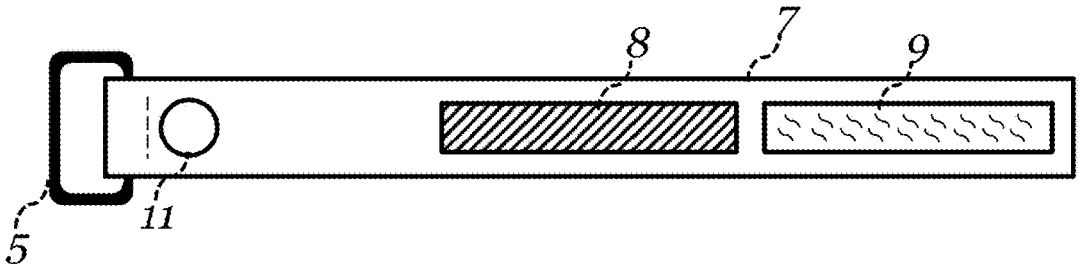
FIG. 5B provides a schematic representation of an exemplary component of an embodiment of a shoe fastening system according to examples of the disclosure.

FIGS. 5A and 5B represent views of straps for exemplary shoe fastening systems in accordance with an embodiment. The strap or straps of the devices described herein can be made out of any suitable material or combination of materials. In some embodiments, at least one of the straps comprises a material selected from the group consisting of nylon, plastic, cotton, leather, and artificial leather. In some embodiments, the strap or straps further comprise grommets for increasing the durability of the strap when securing the strap-eyelet connectors.

Figure 6:
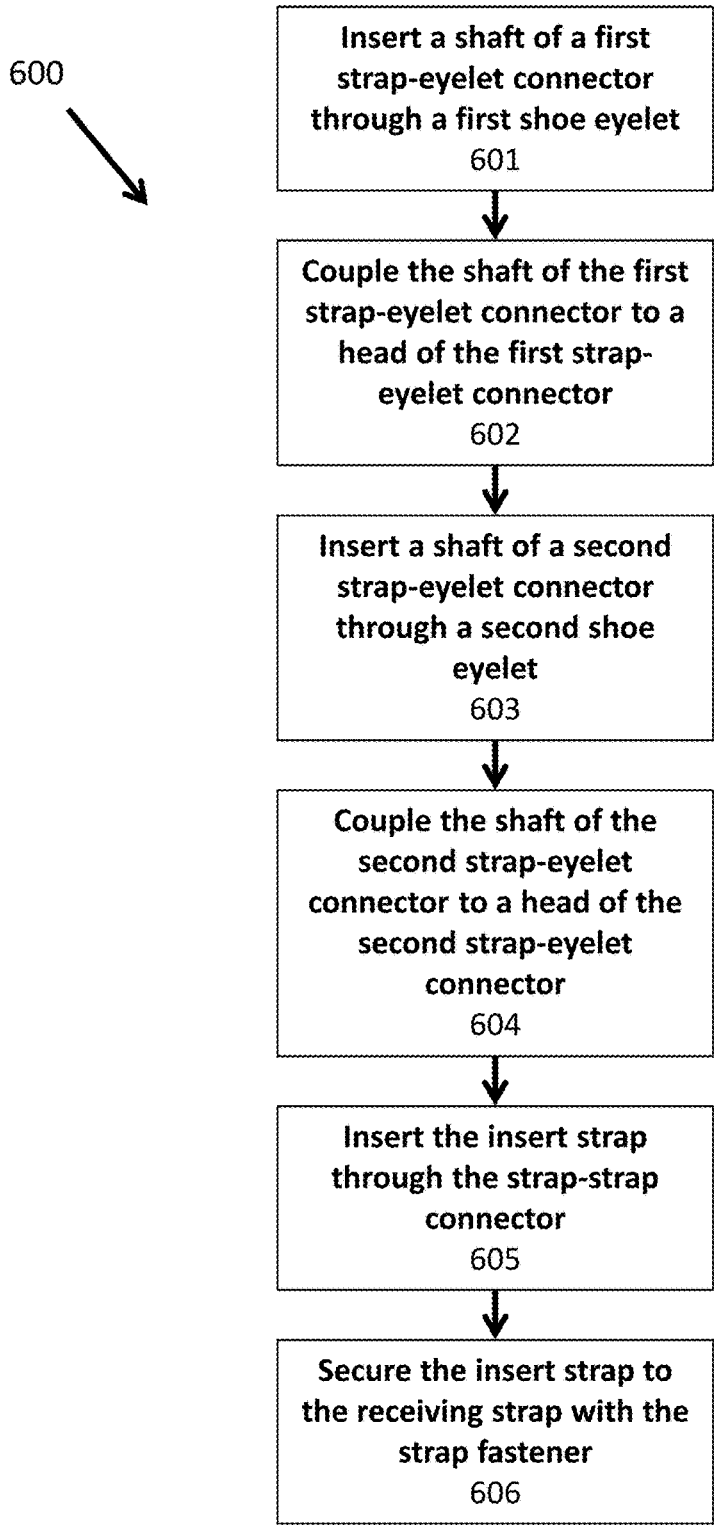
FIG. 6 illustrates a method of fastening a shoe according to examples of the disclosure.

FIG. 6 represents an exemplary method 600 of fastening a shoe in accordance with an embodiment. The method of fastening a shoe comprising a first shoe eyelet and a second shoe eyelet using any of the embodiments described herein comprises inserting the shaft of the first strap-eyelet connector through the first shoe eyelet 601, coupling the shaft of the first strap-eyelet connector to the head of the first strap-eyelet connector 602, inserting the shaft of the second strap-eyelet connector through the second shoe eyelet 603, coupling the shaft of the second strap-eyelet connector to the head of the second strap-eyelet connector 604, inserting the insert strap through the strap-strap connector 605, and securing the insert strap to the receiving strap with the strap fastener 606.

In some embodiments, inserting the shaft of the first strap-eyelet connector through the first shoe eyelet 601 further comprises inserting the shaft of the first strap-eyelet connector through the insert strap. In some embodiments, inserting the shaft of the second strap-eyelet connector through the second shoe eyelet 603 further comprises inserting the shaft of the second strap-eyelet connector through the receiving strap. In some embodiments, the strap fastener comprises a hook and loop fastener. In some embodiments, the shaft of at least one of the first and second strap-eyelet connectors of comprises a base having a diameter greater than or equal to ¼ of an inch. In some embodiments, at least one of the first and second strap-eyelet connectors is selected from the group consisting of a ratchet rivet and a push-in rivet. In some embodiments, at least one of the first and second strap-eyelet connector comprises a Chicago screw. In some embodiments, the strap-strap connector is a ring.

Figure 7:
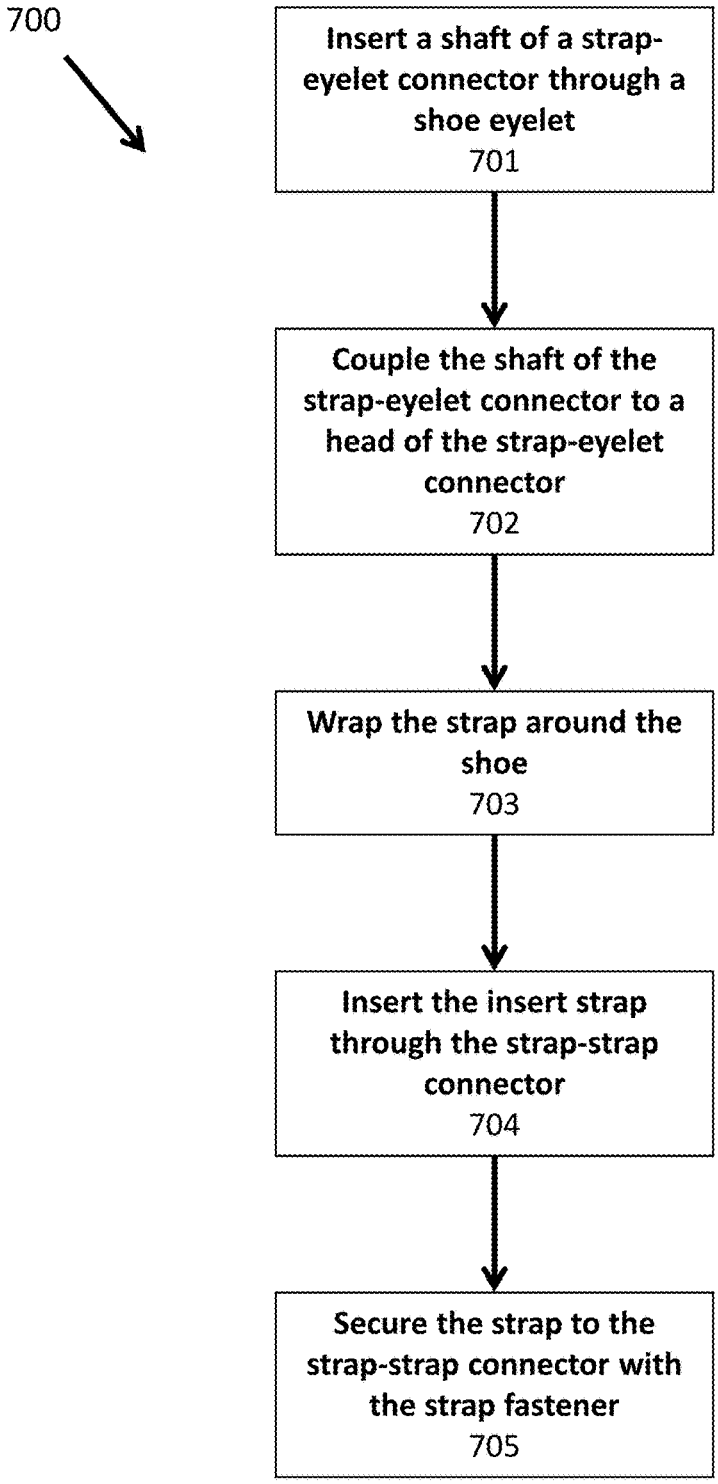
FIG. 7 illustrates a method of fastening a shoe according to examples of the disclosure.

FIG. 7 represents an exemplary method 700 of fastening a shoe in accordance with an embodiment. The method of fastening a shoe comprising a shoe eyelet comprises inserting the shaft of the strap-eyelet connector through the shoe eyelet 701, coupling the shaft of the strap-eyelet connector to the head of the strap-eyelet connector 702, wrapping the strap around the shoe 703, inserting the strap through the strap-strap connector 704, and securing the strap to the strap-strap connector with the strap fastener 705. In some embodiments, wrapping the strap around the shoe 703 includes wrapping the strap around the ankle shaft of a shoe, which can include the portion of a boot or high-top that extends over, and sometimes provides support to, the wearer's ankles.

In some embodiments, inserting the shaft of the strap-eyelet connector through the shoe eyelet 701 further comprises inserting the shaft of the strap-eyelet connector through the strap. In some embodiments, the strap fastener includes a hook and loop fastener. In some embodiments, the shaft of the strap-eyelet connector includes a base having a diameter greater than or equal to ¼ of an inch. In some embodiments, the strap-eyelet connector is selected from the group consisting of a ratchet rivet and a push-in rivet. In some embodiments, the strap-eyelet connector includes a Chicago screw. In some embodiments, the strap-strap connector is a ring.

In some embodiments, a shoe fastening system includes an insert strap comprising a strap fastener and a first strap-eyelet connector configured to attach to a shoe using only one shoe eyelet; and a receiving strap comprising a strap-strap connector and a second strap-eyelet connector configured to attach to the shoe using only one shoe eyelet, wherein the insert strap is sized to be inserted through the strap-strap connector, and wherein the first strap-eyelet connector and second strap-eyelet connector each comprise a head having a diameter greater than or equal to ¼ of an inch and a shaft having a diameter of less than or equal to 3⁄16 of an inch.

In some embodiments of the shoe fastening system, the strap fastener comprises a hook and loop fastener.

In some embodiments of the shoe fastening system, the shaft of at least one of the first and second strap-eyelet connectors comprises a base having a diameter greater than or equal to ¼ of an inch.

In some embodiments of the shoe fastening system, at least one of the first and second strap-eyelet connectors is selected from the group consisting of a ratchet rivet and a push-in rivet.

In some embodiments of the shoe fastening system, at least one of the first and second strap-eyelet connectors comprise a Chicago screw comprising a female internally-threaded nut and a bolt.

In some embodiments of the shoe fastening system, at least one of the first and second strap-eyelet connectors comprise a bolt and a nut, wherein the nut is selected from the group consisting of an acorn nut, crown hex nut, blind nut, cap nut and domed cap nut.

In some embodiments of the shoe fastening system, the strap-strap connector comprises a ring.

In some embodiments of the shoe fastening system, the strap-strap connector comprises a slot aperture in the receiving strap.

In some embodiments of the shoe fastening system, the strap-strap connector comprises a grommet.

In some embodiments of the shoe fastening system, at least one of the insert strap and the receiving strap comprises a material selected from the group consisting of nylon, cotton, and leather.

In some embodiments, a shoe fastening system includes: a strap comprising a strap-strap connector, a strap fastener, and a strap-eyelet connector between the strap-strap connector and the strap fastener, wherein: the strap is sized to be inserted through the strap-strap connector; and the strap-eyelet connector comprises a head having a diameter greater than or equal to ¼ of an inch and a shaft having a diameter of less than or equal to 3⁄16 of an inch.

In some embodiments of the shoe fastening system, the strap fastener includes a hook and loop fastener.

In some embodiments of the shoe fastening system, the shaft of the strap-eyelet connector comprises a base having a diameter greater than or equal to ¼ of an inch.

In some embodiments of the shoe fastening system, the strap-eyelet connector is selected from the group consisting of a ratchet rivet and a push-in rivet.

In some embodiments of the shoe fastening system, the strap-eyelet connector comprises a Chicago screw comprising a female internally-threaded nut and a bolt.

In some embodiments of the shoe fastening system, the strap-eyelet connector further comprises a locking washer in contact with the bolt or the female-internally threaded nut.

In some embodiments of the shoe fastening system, the strap-eyelet connector comprises a bolt and a nut, wherein the nut is selected from the group consisting of an acorn nut, crown hex nut, blind nut, cap nut and domed cap nut.

In some embodiments of the shoe fastening system, the strap-eyelet connector further comprises a locking washer in contact with the bolt or the nut.

In some embodiments of the shoe fastening system, the strap-strap connector is selected from the group consisting of a ring, a slot aperture, and a grommet.

In one embodiment, a method of fastening a shoe using the shoe fastening system of any of the embodiments above, including a first shoe eyelet and a second shoe eyelet, the method includes: inserting the shaft of the first strap-eyelet connector through the first shoe eyelet; coupling the shaft of the first strap-eyelet connector to the head of the first strap-eyelet connector; inserting the shaft of the second strap-eyelet connector through the second shoe eyelet; coupling the shaft of the second strap-eyelet connector to the head of the second strap-eyelet connector; inserting the insert strap through the strap-strap connector, wherein the insert strap is sized to be inserted into the strap-strap connector; and securing the insert strap to the receiving strap with the strap fastener.

In some embodiments, the method further includes: inserting the shaft of the first strap-eyelet connector through the insert strap; and inserting the shaft of the second strap-eyelet connector through the receiving strap.

In some embodiments, the shaft of at least one of the first and second strap-eyelet connectors comprises a base having a diameter greater than or equal to ¼ of an inch.

In some embodiments, at least one of the first and second strap-eyelet connectors is selected from the group consisting of a ratchet rivet and a push-in rivet.

In some embodiments, at least one of the first and second strap-eyelet connectors comprises a Chicago screw comprising a female internally-threaded nut and a bolt.

In some embodiments, the strap-strap connector comprises a ring.

In one embodiment, a method of fastening a shoe using the shoe fastening system of any of the embodiments above, wherein the shoe comprises a shoe eyelet, the method includes: inserting the shaft of the strap-eyelet connector through the shoe eyelet; coupling the shaft of the strap-eyelet connector to the head of the strap-eyelet connector; wrapping the strap around the shoe; inserting the strap through the strap-strap connector; and securing the strap to the strap-strap connector with the strap fastener.

In some embodiments, the method includes inserting the shaft of the strap-eyelet connector through the strap.

In some embodiments, the strap fastener comprises a hook and loop fastener.

In some embodiments, the shaft of the strap-eyelet connector comprises a base having a diameter greater than or equal to ¼ of an inch.

In some embodiments, the strap-eyelet connector is selected from the group consisting of a ratchet rivet and a push-in rivet.

In some embodiments, the strap-eyelet connector comprises a Chicago screw comprising a female internally-threaded nut and a bolt.

In some embodiments, the strap-strap connector comprises a ring.

In one embodiment, a shoe fastening system, wherein a shoe comprises a first shoe eyelet and a second shoe eyelet, includes: a first means for connecting an insert strap comprising a strap fastener to the first shoe eyelet, said means comprising a first shaft for inserting through the first shoe eyelet and a first head for coupling to the first shaft; a second means for connecting a receiving strap comprising a strap-strap connector to the second shoe eyelet, said means comprising a second shaft for inserting through the second shoe eyelet and a second head for coupling to the first shaft; wherein the first and second head have a diameter greater than or equal to ¼ of an inch and the first and second shaft have a diameter of less than or equal to 3/16 of an inch.

In the above description of embodiments, reference is made to the accompanying drawings which form a part hereof, and in which specific embodiments that can be practiced are shown by way of example. Although the disclosed embodiments have been fully described with reference to the accompanying drawings, it is to be noted that various changes and modifications will become apparent to those skilled in the art. Such changes and modifications are to be understood as being included within the scope of the disclosed embodiments as defined by the appended claims. It should be understood that the various embodiments have been presented by way of example only, and not by way of limitation Likewise, the various diagrams may depict an example architectural or other configuration for the embodiments, which is done to aid in understanding the features and functionality that can be included in the disclosed embodiments. The disclosure is not restricted to the illustrated example architectures or configurations, but can be implemented using a variety of alternative architectures and configurations. Additionally, although the invention is described above in terms of various exemplary embodiments and implementations, it should be understood that the various features and functionality described in one or more of the individual embodiments are not limited in their applicability to the particular embodiment with which they are described. They instead can be applied alone, or in some combination, to one or more of the other embodiments of the invention, whether or not such embodiments are described, and whether or not such features are presented as being a part of a described embodiment. Thus the breadth and scope of the invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; and adjectives such as "conventional," "traditional," "normal," "standard," "known", and terms of similar meaning, should not be construed as limiting the item described to a given time period, or to an item available as of a given time. But instead these terms should be read to encompass conventional, traditional, normal, or standard technologies that may be available, known now, or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements, or components of the invention may be described or claimed in the singular, the plural is contemplated to be within the scope thereof unless limitation to the singular is explicitly stated. The presence of broadening words and phrases such as "one or more," "at least," "but not limited to", or other like phrases in some instances shall not be read to mean that the narrower case is intended or required in instances where such broadening phrases may be absent.

The invention claimed is:

1. A shoe fastening system comprising:

a strap comprising a strap-strap connector, an aperture, a strap fastener, and a strap-eyelet connector between the strap-strap connector and the strap fastener that is configured to pass through the aperture, wherein:

the strap is sized to be inserted through the strap-strap connector;

the strap-eyelet connector comprises a head having a diameter greater than or equal to ¼ of an inch and a shaft having a diameter of less than or equal to 3/16 of an inch;

the strap-eyelet connector comprises a male member and a female member; and the male member passes through the aperture.

2. The shoe fastening system of claim 1, wherein the strap fastener includes a hook and loop fastener.

3. The shoe fastening system of claim 1, wherein the shaft of the strap-eyelet connector comprises a base having a diameter greater than or equal to ¼ of an inch.

4. The shoe fastening system of claim 1, wherein the strap-eyelet connector is selected from the group consisting of a ratchet rivet and a push-in rivet.

5. The shoe fastening system of claim 1, wherein the strap-eyelet connector comprises a Chicago screw comprising a female internally-threaded nut and a bolt.

6. The shoe fastening system of claim 5, wherein the strap-eyelet connector further comprises a locking washer in contact with the bolt or the female-internally threaded nut.

7. The shoe fastening system of claim 1, wherein the strap-strap connector is selected from the group consisting of a ring, a slot aperture, and a grommet.

8. A method of fastening a shoe using the shoe fastening system of claim 1, wherein the shoe comprises a shoe eyelet, the method comprising:

inserting the shaft of the strap-eyelet connector through the shoe eyelet;

coupling the shaft of the strap-eyelet connector to the head of the strap-eyelet connector;

wrapping the strap around the shoe;

inserting the strap through the strap-strap connector; and securing the strap to the strap-strap connector with the strap fastener.

9. The method of claim 8, further comprising inserting the shaft of the strap-eyelet connector through the strap.

10. The method of claim 8, wherein the strap fastener comprises a hook and loop fastener.

* * * * *